US008670516B2

(12) United States Patent
Cho et al.

(10) Patent No.: US 8,670,516 B2
(45) Date of Patent: Mar. 11, 2014

(54) IRRADIATION DEVICE FOR MATERIAL TEST USING GAMMA RAY FROM SPENT NUCLEAR FUEL ASSEMBLY

(75) Inventors: Il Je Cho, Daejeon (KR); Eun Pyo Lee, Daejeon (KR); Dong Hak Kook, Daejeon (KR); Kie Chan Kwon, Daejeon (KR); Won Kyung Lee, Daejeon (KR); Jeong Hoe Ku, Daejeon (KR); Won Myung Choung, Daejeon (KR); Gil Sung You, Daejeon (KR); Ji Sup Yoon, Daejeon (KR)

(73) Assignees: Korea Hydro & Nuclear Power Co., Ltd., Seoul (KR); Korea Atomic Energy Research Institute, Daejeon-si (KR)

( * ) Notice: Subject to any disclaimer, the term of this patent is extended or adjusted under 35 U.S.C. 154(b) by 1426 days.

(21) Appl. No.: 11/754,050

(22) Filed: May 25, 2007

(65) Prior Publication Data

US 2010/0163746 A1 Jul. 1, 2010

(30) Foreign Application Priority Data

May 29, 2006 (KR) ..... 10-2006-0048219

(51) Int. Cl.
*G21C 17/00* (2006.01)

(52) U.S. Cl.
USPC ..... 376/245; 376/340; 376/341; 376/342

(58) Field of Classification Search
USPC ..... 376/245, 340, 341, 342
See application file for complete search history.

(56) References Cited

U.S. PATENT DOCUMENTS 3,042,601 A * 7/1962 Loeb ..... 376/341
3,431,502 A * 3/1969 Stone et al. ..... 315/507

(Continued)

OTHER PUBLICATIONS

R.E. Sharp and S.L. Pater; A Comparison of the Effects of Gamma Radiation From Spent Fuel and Cobalt-60 on Electronic Components; Radiation and Its Effects on Components and Systems, 1993 RADECS 93 Second European Conference on Volume, Issue, Sep. 13-16, 1993; pp. 48-55.

(Continued)

*Primary Examiner* — Jack W Keith
*Assistant Examiner* — Marshall O'Connor
(74) *Attorney, Agent, or Firm* — H.C. Park & Associates, PLC

(57) ABSTRACT

The present invention relates to an irradiation device for material test using a gamma ray radiated from a spent nuclear fuel assembly and provides the irradiation device for material test using a gamma ray radiated from a spent nuclear fuel assembly wherein an irradiation device for material test to achieve a radiation effect evaluation is manufactured to be movable upward, downward and horizontally in order to study the hardening phenomenon of the frail materials to the radiation among the atomic power facilities using a gamma ray radiated from a spent nuclear fuel assembly, thereby it is possible to adjust a position of the spent nuclear fuel used for material test using a gamma ray radiated from a spent nuclear fuel and a test material, identify a distance between the spent nuclear fuel and the test material easily with a scale and evaluate the radiation effects on the materials used at facilities handling a spent nuclear fuel under the same situation as they are really exposed. Further the present invention comprises a support constructed vertically; a vertical moving table which is capable of moving upward and downward connected with a proper position of the support; a moving device for moving said vertical moving table upward and downward; a horizontal moving table which is capable of moving horizontally placed on the vertical moving table; a horizontal moving bar which is capable of moving horizontally placed on the vertical moving table; and a driving device for driving the horizontal moving table and the horizontal moving bar horizontally.

18 Claims, 29 Drawing Sheets

(56) References Cited

U.S. PATENT DOCUMENTS

| | | | | | |
|---|---|---|---|---|---|
| 3,445,651 | A | * | 5/1969 | Starnes | 250/304 |
| 3,622,830 | A | * | 11/1971 | Clay | 313/147 |
| H63 | H | * | 5/1986 | Vogel et al. | 250/491.1 |
| 5,135,706 | A | * | 8/1992 | Costes et al. | 376/245 |
| 6,697,446 | B2 | * | 2/2004 | Kang et al. | 376/202 |

OTHER PUBLICATIONS

S. Coenen, M. Decreton; Gamma Irradiation Facilities for Radiation Tolerance Assessment of Components and Systems at SCK-CEN; Proc. IEEE NSREC 2002, Radiation Effects Data Workshop, Jul. 2002, Pheonix, Arizona USA, pp. 171-176, 2002.

A. Fernandez Fernandez, B. Brichard, and F. Berghmans; Irradiation Facilities at SCK-CEN for Radiation Tolerance Assessment of Space Materials; Proc. 9th International Symposium on Materials in a Space Environment, Jun. 16-20, 2003, Noordwijk, Netherlands, pp. 627-632.

* cited by examiner

IRRADIATION DEVICE FOR MATERIAL TEST USING GAMMA RAY FROM SPENT NUCLEAR FUEL ASSEMBLY

CROSS REFERENCE TO RELATED APPLICATION

This application claims priority from and the benefit of Korean Patent Application No. 10-2006-0048219, filed on May 29, 2006, which is hereby incorporated by reference for all purposes as if fully set forth herein.

BACKGROUND OF THE INVENTION

1. Field of Invention

The present invention relates to an irradiation device to test material using gamma rays radiated from a spent nuclear fuel assembly. In particular, in order to research a hardening process of material weakening due to radiation in atomic power facilities from gamma rays radiated from a spent nuclear fuel assembly, the present invention provides an irradiation device to test material, the device being capable of moving upward, downward and horizontally, thereby controlling a position of a spent nuclear fuel and a test material for a radiation test on the test material using gamma rays radiated from the spent nuclear fuel for accomplishing an evaluation of radiation effects. The present invention further provides an irradiation device for a material test using gamma rays radiated from a spent nuclear fuel assembly in which a scale is placed to discern a distance between the spent nuclear fuel assembly and a test material.

2. Discussion of the Background

A spent nuclear fuel generally generated at a nuclear power or nuclear fuel laboratory generates various kinds of radiation such as a particles, β rays, γ rays, neutrons, etc. and the materials of facilities for handling and storing the spent nuclear fuel are to be irradiated by such radiation rays in a large amount.

Therefore, various kinds of parts and devices constructed in the facilities for handling and storing the spent nuclear fuel are degenerated by being exposed to the radiation circumstance, and this is regarded as a main cause of a malfunction of the parts and devices used for handling the spent nuclear fuel or a decrease in the longevity thereof.

Therefore, in order to operate the facilities for handling and storing the spent nuclear fuel safely, it is important to evaluate the effects caused by radiation of various kinds on nuclear power material.

In order to do so, the experiments to identify a degeneration phenomenon of the materials exposed to radiation circumstance, need to consider effects caused by neutral particles, alpha particles and beta rays among the radiation generated from the spent nuclear fuel, which except for effects caused by gamma rays are so scarce, since experiments for identifying the degeneration phenomenon of the materials exposed to the radiation circumstance are performed under the gamma ray irradiation until now.

To perform such experiments, the existing facilities for an irradiation test using gamma rays have mainly used $^{60}$Co sources and the gamma rays evaluation test of gamma rays on materials are partially performed using $^{137}$Cs sources.

In the existing gamma ray irradiation facility, using $^{60}$Co sources and $^{137}$CS sources, where the gamma rays energies are at 1.17 MeV, 1.332 MeV and at 0.662 MeV respectively, cannot describe a various energy spectrum of gamma rays generated from a spent nuclear fuel and the effects thereof on material.

Since such energy and flux-to-dose-rate of gamma rays generated from a spent nuclear fuel assembly have a various spectrum according to burn-up, cooling time, position and distance of nuclear fuel assembly, it is required to develop and make an irradiation device to describe the various circumstances of gamma ray irradiation radiated from a spent nuclear fuel.

SUMMARY OF INVENTION

The present invention provides an irradiation device to test material capable of moving upward, downward and horizontally to accomplish an evaluation of radiation effects, thereby controlling a position of a spent nuclear fuel and a test material for a radiation test on the test material using gamma rays radiated from the spent nuclear fuel and further provides an irradiation device to test material using gamma rays radiated from a spent nuclear fuel assembly in which a scale is placed to discern a distance between the spent nuclear fuel assembly and the test material.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE PREFERRED EMBODIMENTS

Figure 1:
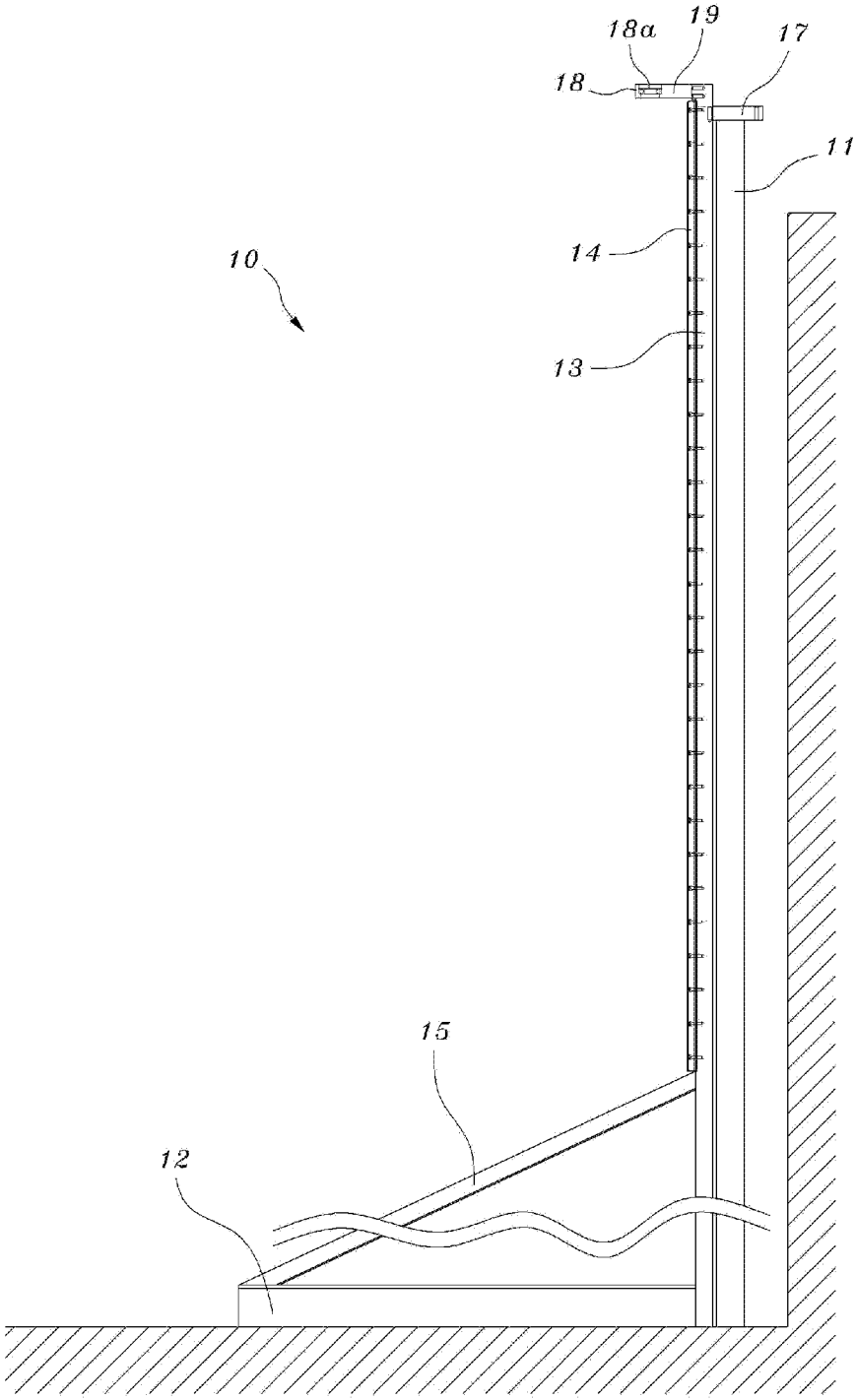
FIG. 1 represents a front view of a support of an irradiation device to test material using gamma rays radiated from a spent nuclear fuel assembly of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

The present invention provides an irradiation device to test material using gamma rays radiated from a spent nuclear fuel assembly which includes a support placed in the vertical direction; a vertical moving table which is capable of moving upward and downward connected with a position of the support; a moving device for moving said vertical moving table upward and downward; a horizontal moving table which is capable of moving horizontally placed on the vertical moving table; a horizontal moving bar which is capable of moving horizontally placed on the vertical moving table; and a driving device for driving the horizontal moving table and the horizontal moving bar horizontally.

Desirably, the support comprises shaped steels, each having two wings and both wings separated from each other by a fixed space distance, a bottom plate placed horizontally under the shaped steels, a flat plate having a plate body placed in front of the shaped steels with a longitudinal direction, and a linear guide rail placed on each of the right and left side of the front of the flat plate.

In this place, a reinforcement member slopes at a fixed angle on a position of a front-below side of the flat plate and on an end portion of one side of the bottom plate.

And a guide having a flat plate body is formed on a front-top of the flat plate, the guide is connected with the flat plate by a plate body and a guide hole is pierced on the top of the guide through the flat plate body.

Meanwhile, a support plate having a plate body is constructed on the top of the back side of the flat plate.

In this place, the vertical moving table is composed of an upper plate having a plate body, a lower plate spaced apart from the upper plate by a fixed distance, the lower plate substantially the same length and shape as the upper plate and a vertical flat plate placed vertically on one end of the upper plate and a corresponding one end of the lower plate, respectively.

And a reinforcement member slopes at a fixed angle on the bottom end of the vertical flat plate and another end of the lower plate.

In addition, both sides of one end of the upper plate and the lower plate have L-shaped coupling parts respectively and a plurality of slider blocks are placed in the vertical direction to each of the coupling parts.

And a coupling hole having a fixed diameter is pierced on a portion in the middle part of the upper plate and the lower plate respectively.

Also, a plurality of taps for combining a locking member therewith are pierced on the upper plate and the lower plate.

Meanwhile, a scale having a fixed length is placed on a position of the upper plate.

In this place, the moving device consists of a moving handle to apply a turning force, a decelerator for reducing the turning force provided by the moving handle, a bevel gear to apply a torque increased according as the turning force is reduced by the decelerator, a ball screw having a round bar shape connected with the bevel gear and a ball screw nut placed on a position of the ball screw.

Desirably, support units are placed respectively on a position of both ends of the ball screw.

Meanwhile, the horizontal moving table consists of a moving plate formed to be a plate body, a ball screw having a ball screw nut connected to a lower side of the moving plate, a bevel gear connected to one of the ends of the ball screw and a hinge bracket connected to the bevel gear.

In this place, support units are placed respectively on a portion of both ends of the ball screw.

And a plurality of slider blocks are placed on both sides of the lower side of the moving plate and a linear guide rail for moving the moving plate is combined with the slide blocks.

Desirably, a fixed part of a pointer in a position on the moving plate in the shape of a wedge is exposed to the outside.

In addition, a shaft having a square section on the top of the hinge bracket is projected upward.

Meanwhile, the horizontal moving bar consists of a moving piece in the shape of a square bar, a ball screw having a ball screw nut connected with one end of the moving piece, a bevel gear connected with one of the ends of the ball screw and a hinge bracket connected with the bevel gear.

Desirably, a slider block is formed on the end of the moving piece, a slide bar is connected with the slider block by inserting therein and an end of the slide bar and the ball screw nut are connected by a damping spring.

And support units are placed respectively on a portion of both end sides of the ball screw.

In addition, brackets having a guide roller for guiding a movement of the moving piece are placed respectively on both sides of the moving piece.

In this place, a scale is built on the upper side of the moving piece.

And a shaft having a square section on the upper side of the hinge bracket is projected upward.

Meanwhile the driving device consists of a long driving bar having a round bar shape and a driving handle placed on the top end of the driving bar.

Desirably, a coupling groove having a square section is formed on the lower side end of the driving bar.

In this place, a shield and a reservoir for holding an atomic power material is further included.

Desirably, the reservoir is in the shape of a hexahedron with an open top which includes a housing having an atomic power material and shielding body therein and a lid placed on the open top of the housing.

Alternatively, a gasket is interposed between the housing and the lid.

In this place, the gasket is made of metal material.

Alternatively, the gasket is made of synthetic resin material.

In this place, a plurality of locking holes having a locking member are pierced in the edge of the lid and a plurality of locking holes for installing a locking member are pierced in a flange in the upper and lower edges of the housing.

And the shielding body consists of an upper shielding body and a lower shielding body and a setting groove for inserting and installing an atomic power material into a position of one side of the lower shielding body.

In addition, an I bolt is placed on a position of both upper sides of the upper shielding body.

Examples according to the present invention are explained in detail hereinafter referring to the attached figures.

Figure 2:
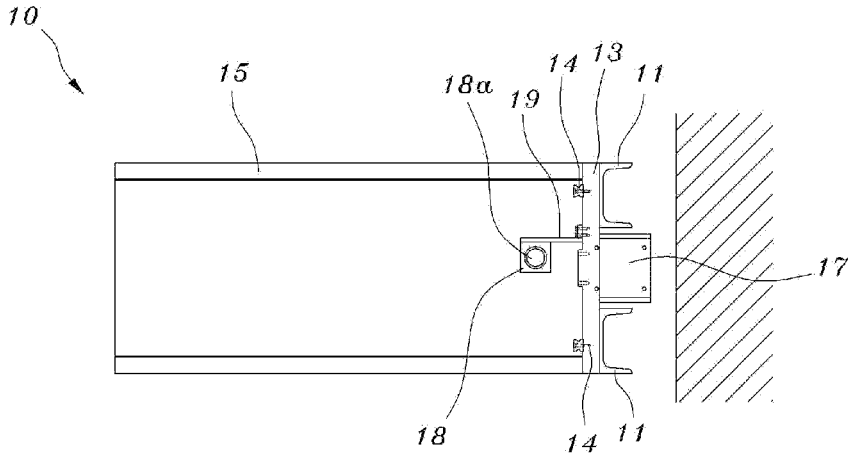
FIG. 2 represents a plan view of the support of an irradiation device of FIG. 1.
Figure 3:
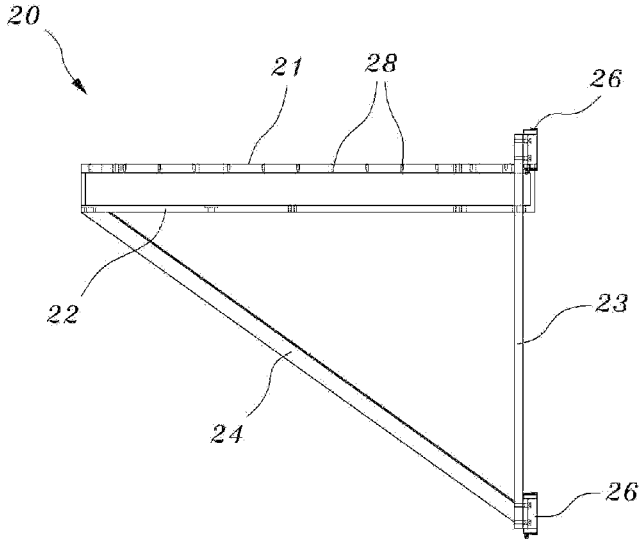
FIG. 3 represents a front view of a vertical moving table of an irradiation device to test material using gamma rays radiated from a spent nuclear fuel assembly of the present invention.
Figure 4:
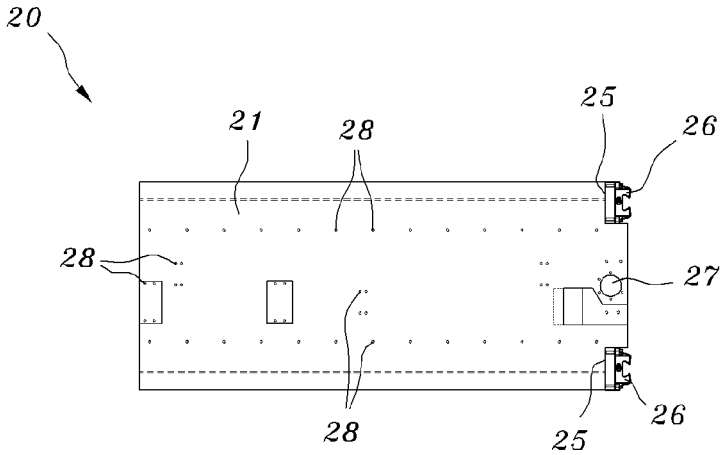
FIG. 4 represents a plan view of the vertical moving table of FIG. 3.
Figure 5:
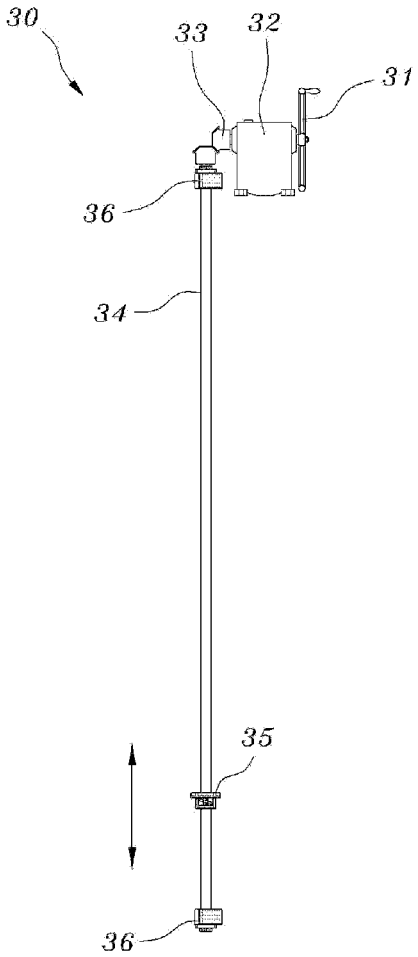
FIG. 5 represents a front view of a moving device for moving a vertical moving table of an irradiation device to test material using gamma rays radiated from a spent nuclear fuel assembly of the present invention.
Figure 6:
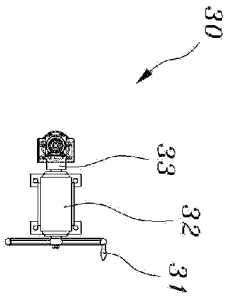
FIG. 6 represents a plan view of the moving device for moving a vertical moving table of FIG. 5.
Figure 7:
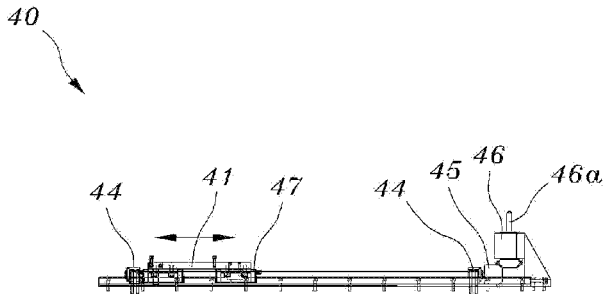
FIG. 7 represents a front view of a horizontal moving table of an irradiation device to test material using gamma rays radiated from a spent nuclear fuel assembly of the present invention.
Figure 8:
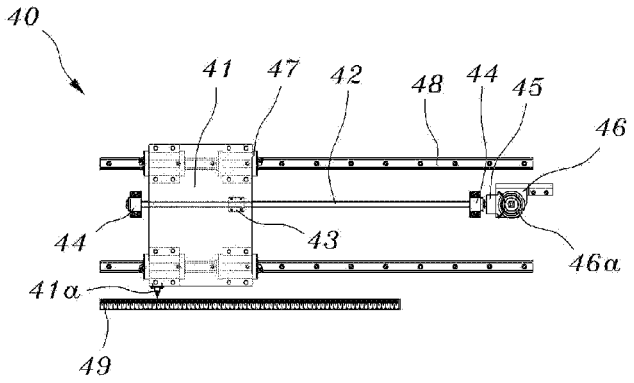
FIG. 8 represents a plan view of the horizontal moving table of FIG. 7.
Figure 9:
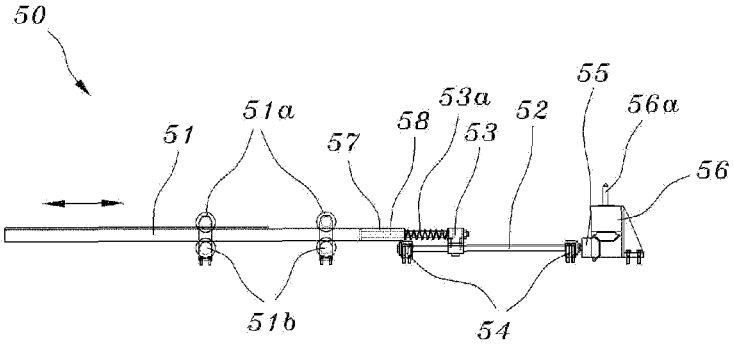
FIG. 9 represents a front view of a horizontal moving bar of an irradiation device to test material using gamma rays radiated from a spent nuclear fuel assembly of the present invention.
Figure 10:
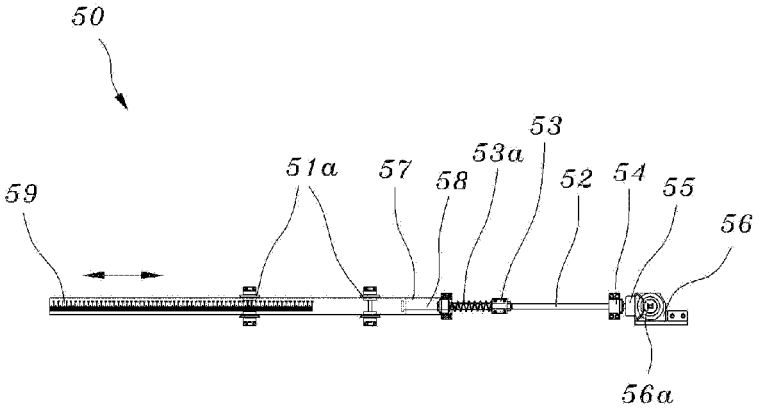
FIG. 10 represents a plan view of the horizontal moving bar of FIG. 9.
Figure 11:
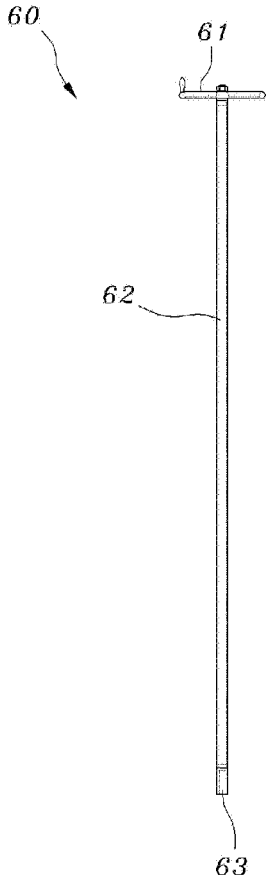
FIG. 11 represents a front view of a driving handle of an irradiation device to test material using gamma rays radiated from a spent nuclear fuel assembly of the present invention.
Figure 12:
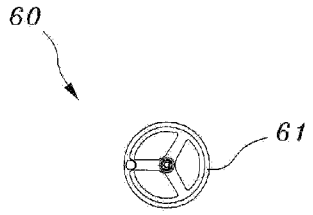
FIG. 12 represents a plan view of the driving handle of FIG. 11.

FIG. 1 represents a front view of a support of an irradiation device to test material using gamma rays radiated from a spent nuclear fuel assembly of the present invention, FIG. 2 represents a plan view of the support of an irradiation device of FIG. 1, FIG. 3 represents a front view of a vertical moving table of an irradiation device to test material using gamma rays radiated from a spent nuclear fuel assembly of the present invention, FIG. 4 represents a plan view of the vertical moving table of FIG. 3, FIG. 5 represents a front view of a moving device for moving a vertical moving table of an irradiation device to test material using gamma rays radiated from a spent nuclear fuel assembly of the present invention, FIG. 6 represents a plan view of the moving device for moving a vertical moving table of FIG. 5, FIG. 7 represents a front view of a horizontal moving table of an irradiation device to test material using gamma rays radiated from a spent nuclear fuel assembly of the present invention, FIG. 8 represents a plan view of the horizontal moving table of FIG. 7, FIG. 9 represents a front view of a horizontal moving bar of an irradiation device to test material using gamma rays radiated from a spent nuclear fuel assembly of the present invention, FIG. 10 represents a plan view of the horizontal moving bar of FIG. 9, FIG. 11 represents a front view of a driving handle of an irradiation device to test material using gamma rays radiated from a spent nuclear fuel assembly of the present invention, FIG. 12 represents a plan view of the driving handle of FIG. 11.

As shown in the figures, the irradiation device 1 to test material using gamma rays radiated from a spent nuclear fuel assembly of the present invention comprises a support 10, a vertical moving table 20, a moving device 30, a horizontal moving table 40, a horizontal moving bar 50 and a driving device 60.

The support 10 (FIG. 1 and FIG. 2) comprises shaped steels 11 each having two wings and both wings separated from each other by a fixed space distance, a bottom plate 12 placed horizontally under each shaped steel 11, a flat plate 13 having a plate body placed in front of each of the shaped steels 11 with a longitudinal direction, a linear guide rail 14 placed on each right and left side of the front of the flat plate 13.

In this place, the linear guide rail 14 is placed in the vertical direction to the flat plate 13 and placed on a position of right and left sides of the flat plate 13.

Meanwhile, a reinforcement member 15 for supporting the flat plate 13 slopes at a fixed angle on a position of a front-below side of the flat plate 13 and on a position of an end portion of the bottom plate 12.

And the front side of each shaped steel 11 is connected with the back side of the flat plate 13 and supports the flat plate 13. That is, the flat plate 13 is placed in the vertical direction and each shaped steel 11 is placed to be in contact with each side of the back side of the flat plate 13 having a long plate body, thereby reinforcing the flat plate 13.

Meanwhile, a guide 18 having a flat plate body is formed on a front-top of the flat plate 13 and a lateral side of the guide 18 is connected with the front side of the flat plate 13 by a plate body 19, but the guide 18 and the flat plate 13 are spaced apart from each other by a fixed distance and a guide hole 18*a* is pierced on the top of the guide 18 through the flat plate body.

Figure 23:
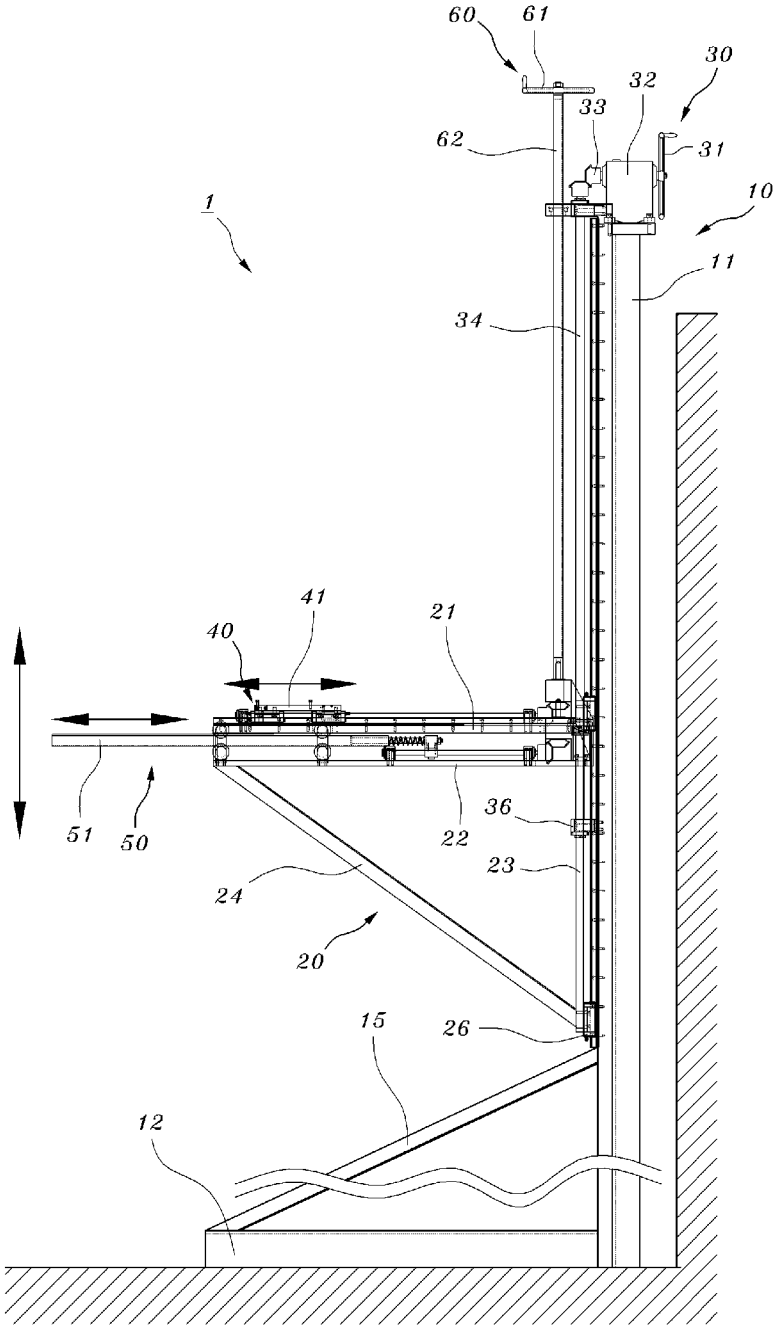
FIG. 23 represents a front view of an irradiation device to test material using gamma rays radiated from a spent nuclear fuel assembly of the present invention.

Also, the guide hole 18*a* is pierced in the central part of the guide 18 and the guide hole 18*a* is connected with a bar 62 of the driving device 60 (FIG. 11) described later by inserting therein and has a spin-pair relations with each other (FIG. 23).

In this place, it is preferable that guides 18 placed on a front-upper side of the flat plate 13 be placed on each side of the flat plate 13 symmetrically with respect to the center of the flat plate 13.

Also, a support plate 17 having a plate body is constructed on a position of the back-upper side of the flat plate 13 in order for the moving device 30 to be placed.

The vertical moving table 20 (FIG. 3 and FIG. 4) is composed of an upper plate 21 having a plate body, a lower plate 22 spaced apart from the upper plate 21 by a fixed distance the lower plate 22 substantially the same length and shape as the upper plate 21 corresponding thereto, a vertical flat plate 23 placed vertically on the both sides of one end of the upper plate and the lower plate 21, 22 respectively and a reinforcement member 24 sloped at a fixed angle on the bottom end of the vertical flat plate 23 and the other end of the lower plate 22.

In this place, the reinforcement member 24 sloped at a fixed angle between the lower plate 22 and the vertical flat plate 23 not only supports the lower plate 22 but also reinforces the relations of the upper plate and the lower plate 21, 22 and the vertical flat plate 23.

Meanwhile, both sides of the one ends of the upper plate and the lower plate 21, 22 have L-shaped coupling parts 25 respectively and slider blocks 26 for moving upward and downward when connected with the linear guide rails 14 which are placed on both right and left sides of the flat plate 13 of the support 10, the slider blocks 26 are placed in the vertical direction to each of the coupling parts 25 and are constructed on the upper and lower ends of each vertical flat plate 23.

An example of the present invention teaches that there are four slide blocks 26 constructed on the upper and lower ends of each vertical flat plate 23 but the slide blocks 26 can be more or less than four.

And a coupling hole 27 with a fixed diameter corresponding to a ball screw nut 35 of the moving device 30 (FIG. 5 and FIG. 6) as described later is pierced on a position of the one ends of the upper and the lower plates 21, 22 in order to be connected with the ball screw nut 35.

In addition, a plurality of taps 28 for combining a locking member therewith are pierced on the upper plate and the lower plate 21, 22.

In this place, a scale 49 (see FIG. 8 and FIG. 18) having a fixed length is placed on a position of the upper plate 21 of the vertical moving table 20.

The moving device 30 for moving the vertical moving table 20 upward and downward consists of a moving handle 31, a decelerator 32 for reducing the turning force provided by the moving handle 31, a bevel gear 33 for a torque increased according as the turning force is reduced by the decelerator 32 to be applied, a ball screw 34 having a round bar shape connected with the bevel gear 33 and a ball screw nut 35 placed on a position of the ball screw 34.

In this place, support units 36 to be locked by a locking member such as a bolt are placed respectively on both end sides of the ball screw 34.

In case of spinning the moving handle 31 by the above-said constitution, a turning force of the moving handle 31 is delivered to a ball screw 34 through the decelerator 32 and the bevel gear 33 and the ball screw 34 is spun by the delivered turning force.

In the case of spinning the moving handle 31 by such a constitution, a turning force of the moving handle 31 is delivered to the ball screw 34 through the decelerator 32 and the bevel gear 33 and the delivered turning force spins the ball screw 34.

And a ball screw nut 35 can be placed on a position of the ball screw 34 and by the spinning of the ball screw 34 the ball screw nut 35 moves upward and downward.

At this time, support units 36 placed respectively on both ends of the ball screw 34 are fixed by a locking member (non-illustrated).

In this place, it is preferable that a separate handle be further equipped to the moving handle 31 for workers to chuck and spin the moving handle 31.

The horizontal moving table 40 (FIG. 7 and FIG. 8) consists of a moving plate 41 formed to be a plate body, a ball screw 42 having a ball screw nut 43 connected to a low part side of the moving plate 41, a bevel gear 45 connected to one of the end sides of the ball screw 42 and a hinge bracket 46 connected to the bevel gear 45.

In this place, support units 44 are locked and fixed by a locking member (non-illustrated) respectively on a position of both end sides of the ball screw 42 and the ball screw nut 43 moves horizontally on the ball screw 42 by the spinning of the ball screw 42.

Meanwhile, as stated above, in order to move the moving plate 41 connected with the ball screw nut 43 by moving of the ball screw nut 43 caused by the spinning of the ball screw 42, a plurality of slider blocks 47 are placed on a position of each side of the low part side of the moving plate 41 and linear guide rails 48 for moving the moving plate 41 according to the spinning of the ball screw 42 are combined with the slide blocks 47 in order for the slide blocks 47 to slide thereon wherein the linear guide rails 48 are connected by the locking member (non-illustrated) respectively with a position in the longitudinal direction of each side of the upper side of the upper plate 21 of the vertical moving table 20. In this place, a fixed part of a pointer 41*a* in a position of the moving plate 41 in the shape of a wedge is exposed to the outside, and the scale 49 is placed in a longitudinal direction of a position corresponding to the pointer 41*a* wherein the scale 49 is placed on a position of the upper plate 21 of the vertical moving table 20.

In the case of horizontally moving the moving plate 41 of the horizontal moving table 40 by the constitution as stated above, a pointer 41*a* placed on a position of the moving plate 41 indicates the graduations of the scale 49 placed on a position of the upper plate 21 of the vertical moving table 20, thereby measuring the horizontal moving distance of the moving plate 41.

Meanwhile, a shaft 46*a* having a square section on the top of the hinge bracket 46 is projected upward wherein the shaft 46*a* is connected with the driving device 60 (FIG. 11) stated later and the shaft 46*a* spins.

The horizontal moving bar 50 (FIG. 9) consists of a moving piece 51 in the shape of square bar, a ball screw 52 having a ball screw nut 53 connected with one end of the moving piece 51, the ball screw 52 placed in a horizontal direction, a bevel gear 55 connected with one end of the ball screw 52 and a hinge bracket 56 connected with the bevel gear 55.

In this place, a damping spring 53*a* is placed between the end sides of the ball screw nut 53 of the ball screw 52 and the one end of the moving piece 51, thereby connecting the ball screw nut 53 and the moving piece 51.

Meanwhile, a slider block 57 is formed on the one end of the moving piece 51, a slide bar 58 is connected with the slider block 57 by inserting therein and an end of the slide bar 58 and the ball screw nut 53 are connected by the damping spring 53*a*.

And support units 54 are fixed by a locking member (non-illustrated) and placed respectively on a portion of both ends of the ball screw 52 wherein the ball screw 52 spins centering around each support unit 54, thereby making the ball screw nut 53 placed on a position of the ball screw 52 able to move horizontally.

According to the above-said constitution, the ball screw nut 53 moves horizontally by the spinning of the ball screw 52, the ball screw nut 53 is inserted into the damping spring 53*a* connected with the end thereof, and the slide bar 58 is combined with the slider block 57 connected with the damping spring 53*a*, thereby moving a moving piece 51 horizontally.

At this time, a bracket 51*b* having a guide roller 51*a* for guiding the moving piece 51 is constructed on a position of both sides of the moving piece 51 of the horizontal moving bar 50 and the bracket 51*b* is connected with an upper side of the lower plate 22 of the vertical moving table by a locking member (non-illustrated).

In this place, a scale 59 is built on an upper side of the moving piece 51 wherein it is possible to identify and measure a distance between a spent nuclear fuel assembly and a vertical moving table 20 during gamma ray irradiation by the scale 59.

Meanwhile, a shaft 56*a* having a square section on the upper side of the hinge bracket 56 is projected upward and is connected with a driving bar 64 of the driving device 60 (FIG. 11) as stated later.

The driving device 60 (FIG. 11 and FIG. 12) consists of a long driving bar 62 having a round bar shape and a driving handle 61 placed on the top end of the driving bar 62.

In this place, a coupling groove 63 having a square section is formed on the lower end of the driving bar 62 and is connected with the shafts 46*a*, 56*a* (see FIG. 7 and FIG. 9) having a square section projected upward on the upper side of the hinge brackets 46, 56 which are placed respectively on the horizontal moving table 40 and the horizontal moving bar 50, and in the case of spinning the driving handle 61 of the driving device 60, the hinge brackets 46, 56 of the horizontal moving table 40 and the horizontal moving bar 50 spin accordingly and a moving plate 41 of the horizontal moving table 40 and a moving piece 51 of the horizontal moving bar 50 move.

Meanwhile, it is preferable that a separate handle be further equipped to the driving handle 61 for workers to chuck and spin the driving handle 61.

An example of the present invention teaches that the coupling groove 63 formed on the lower end of the driving bar 62 of the driving device 60 has a square section but it can have triangle, hexagon or octagon section and it is preferable that the shafts 46*a*, 56*a* of each hinge brackets 46, 56 connected with the coupling groove 63 be formed to correspond to a section shape of the coupling groove 63.

A combination process of an irradiation device 1 to test material using gamma rays radiated from a spent nuclear fuel assembly of the present invention is explained hereinafter referring to FIGS. 13-24.

Figure 13:
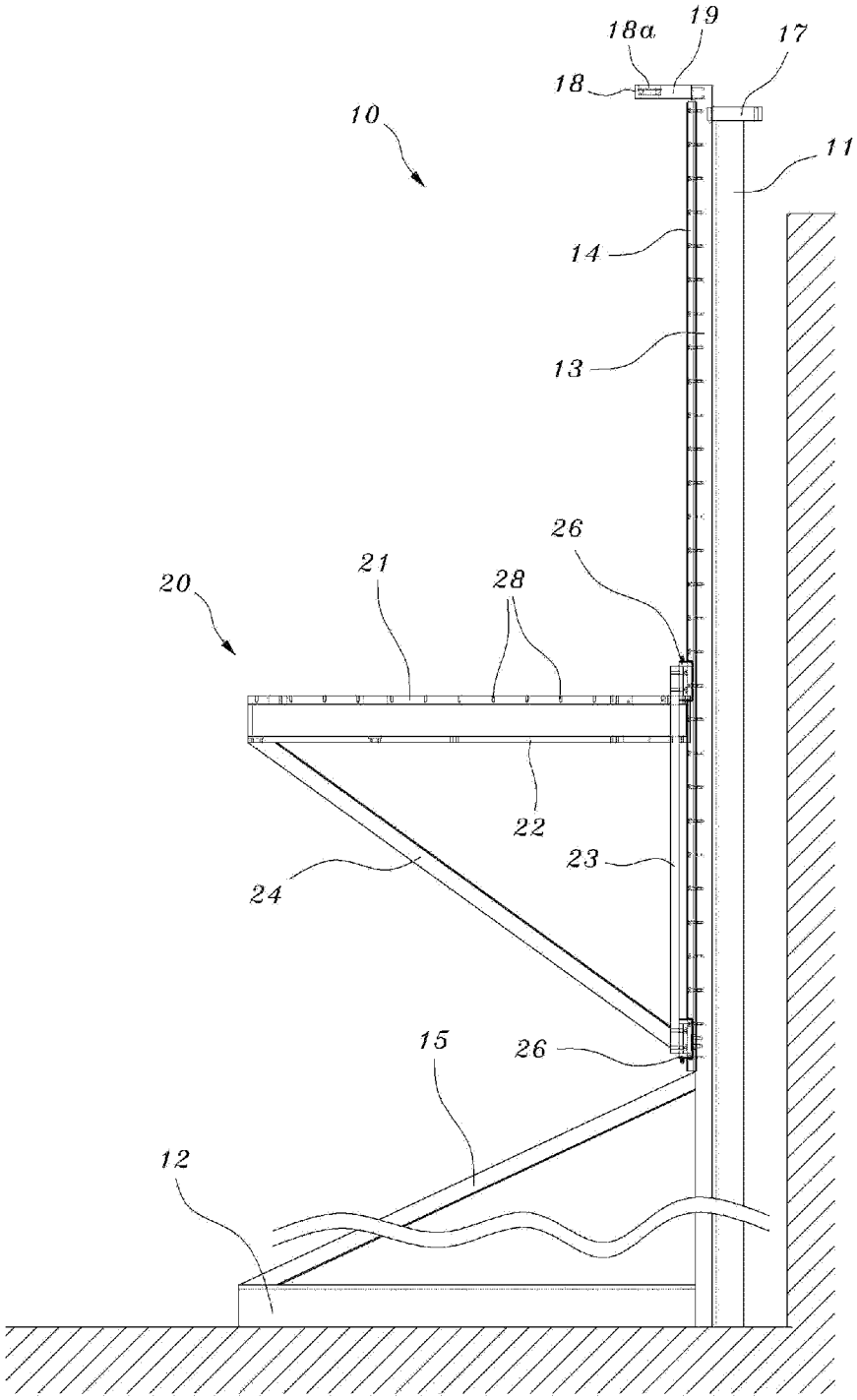
FIG. 13 represents a front view of a combination of the support of FIG. 1 and the vertical moving table of FIG. 3 of the present invention.
Figure 14:
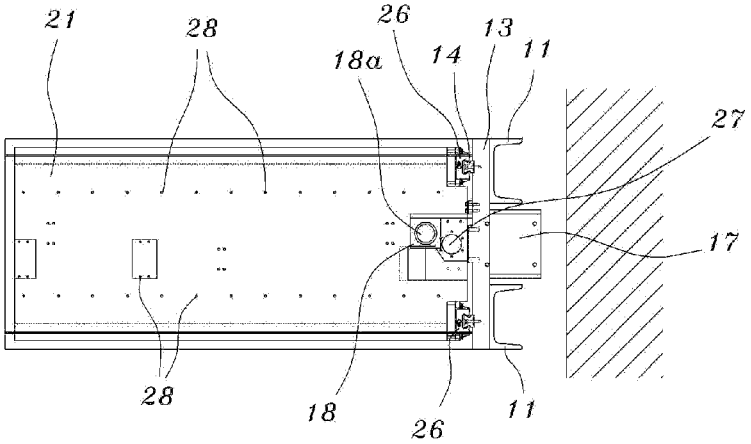
FIG. 14 represents a plan view of the combination of FIG. 13.

First of all, a combination process of the support 10 and the vertical moving table 20 of the irradiation device 1 to test material using gamma rays radiated from a spent nuclear fuel assembly of the present invention is explained referring to FIGS. 13-14.

The vertical moving table 20 is constructed on the support 10 and the flat plate 13. That is, the slider blocks 26 placed in the vertical direction on the vertical flat plate 23 of the vertical moving table 20 are combined with the linear guide rails 14 placed in the vertical direction on each of the right and left sides of the flat plate 13 of the support 10.

As stated above, combining the slide blocks 26 of the vertical moving table 20 with the linear guide rail 14 of the support 10 makes the vertical moving table 20 move on the guide rail 14 of the support 10.

In this manner, a vertical moving table 20 is placed on the support 10 and then the support 10 and the moving device 30 for moving the vertical moving table 20 upward and downward are combined together.

Figure 15:
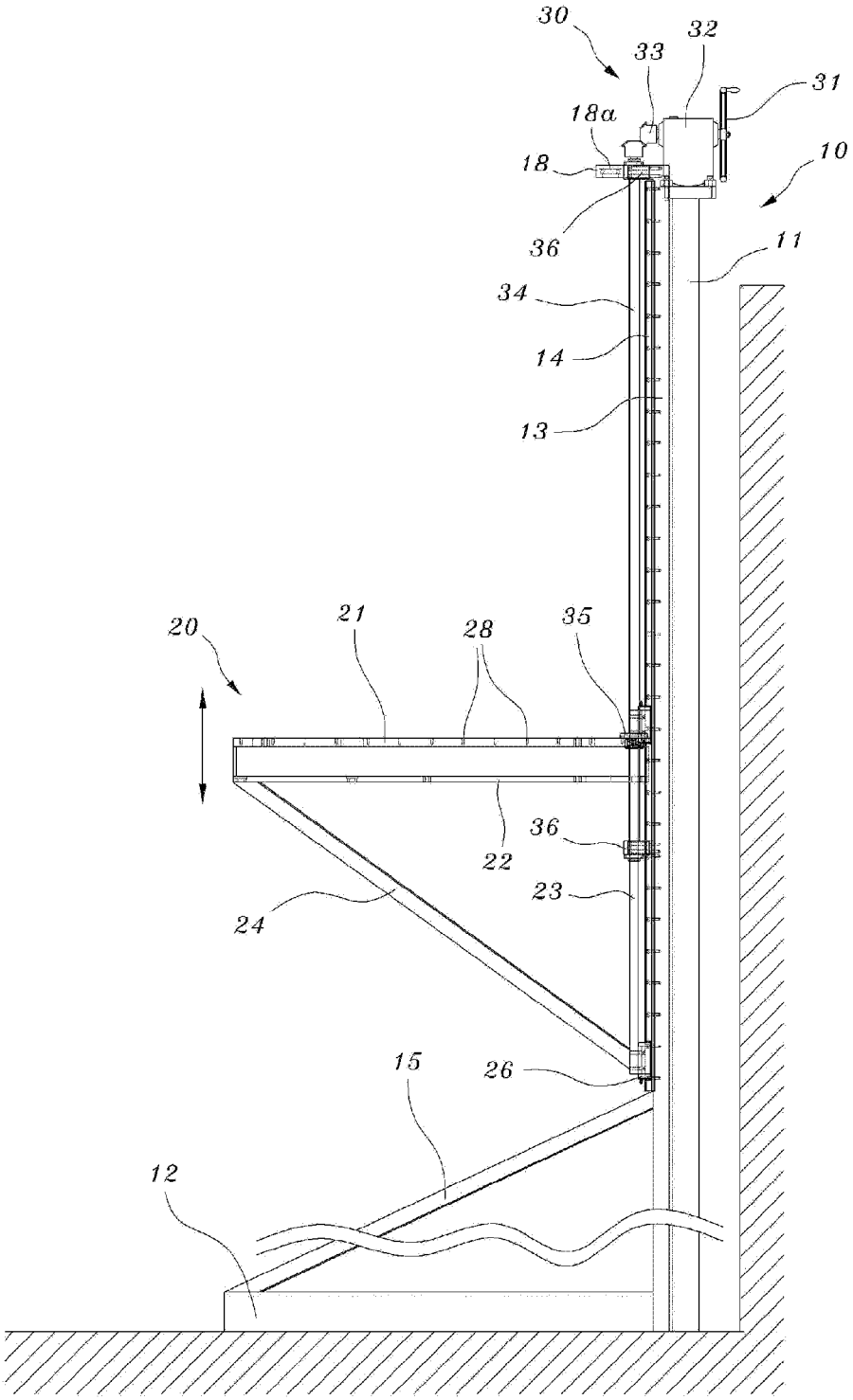
FIG. 15 represents a front view of a combination of the support of FIG. 1, the vertical moving table of FIG. 3 and the moving device of FIG. 5 of the present invention.
Figure 16:
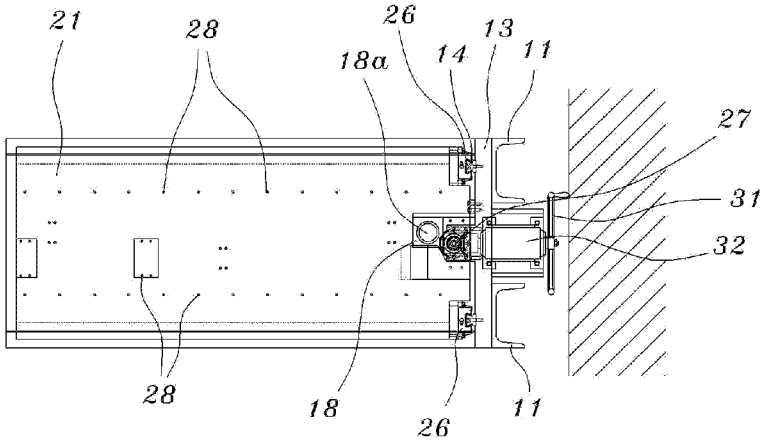
FIG. 16 represents a plan view of the combination of FIG. 15.

That is, as illustrated in FIGS. 15 and 16, the vertical moving table 20 is constructed on the support 10 and the decelerator 32 of the moving device 30 is laid on the support plate 17 placed on the upper side of the flat plate 13 of the support 10 (see FIGS. 13 and 14).

At this time, the ball screw nut 35 of the ball screw 34 connected with the decelerator 32 by the bevel gear 33 in the vertical direction is fixed by combining with the coupling hole 27 pierced on a position of the end side of the upper plate 21 of the vertical moving table 20 and the support units 36 placed respectively on a position of both ends of the ball screw 34 are connected with a position of the upper and lower portions of the front side of the flat plate 13 of the support 10 by a locking member (non-illustrated).

In this place, a decelerator 32 placed on the support plate 17 constructed on the upper side of the flat plate 13 of the support 10 is connected with the support plate 17 and fixed by a locking member.

Meanwhile, a ball screw 34 connected with the bevel gear 33 is placed on the upper side of the flat plate 13 of the support 10 and is built between plate bodies 19 (see FIG. 1 and FIG. 2) connecting the guide 18 with the flat plate 13 at a fixed distance from each other.

And then, a horizontal moving table 40 is combined with the vertical moving table 20.

Figure 17:
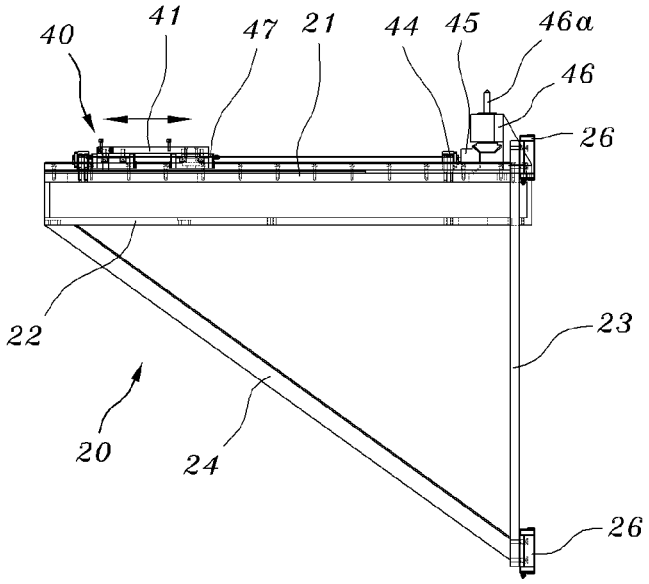
FIG. 17 represents a front view of a combination of the vertical moving table of FIG. 3 and the horizontal moving table of FIG. 7 of the present invention.
Figure 18:
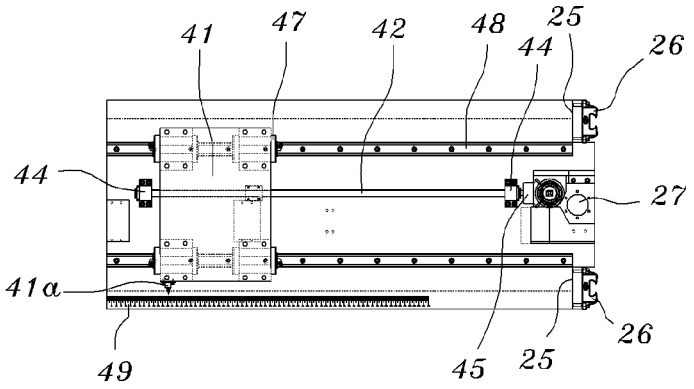
FIG. 18 represents a plan view of the combination of FIG. 17.

That is, referring to FIGS. 17 and 18, the linear guide rails 48 are fixed on the plurality of taps 28 (see FIG. 3 and FIG. 4) placed on a position of both the right and left sides of the upper plate 21 in the longitudinal direction by a locking member (non-illustrated).

That is, the linear guide rails 48 are placed respectively on the taps 28 pierced on both right and left sides of the upper plate 21 in a longitudinal direction by using a locking member.

And the slider blocks 47 placed respectively on the lower side of the moving plate 41 of the horizontal moving table 40 are combined with each linear guide rail 48 locked on the upper plate 21 to be movable.

At this time, the end of the ball screw 42 connected with the moving plate 41 by the ball screw nut 43 (see FIG. 8) is connected with the upper side of the vertical moving table 20 by a hinge bracket 46.

As stated above, the horizontal moving table 40 is placed on the upper plate 21 of the vertical moving table 20 and the scale 49 is placed on one side of the upper plate 21 of the vertical moving table 20 wherein the scale 49 is placed on a corresponding position to the pointer 41*a* placed on the moving plate 41.

And then, the horizontal moving bar 50 is built between the upper and lower plates 21, 22 of the vertical moving table 20.

Figure 19:
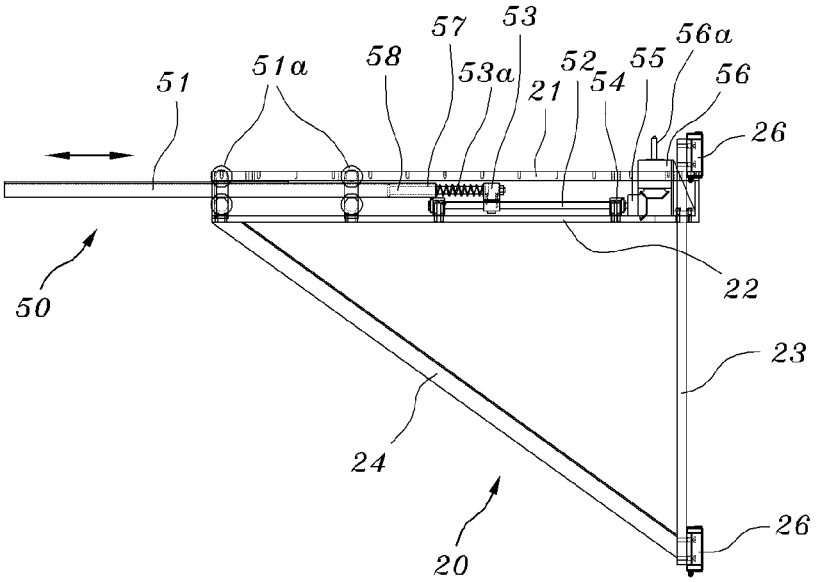
FIG. 19 represents a front view of the horizontal moving bar of FIG. 9 constructed on the vertical moving table of FIG. 3 of the present invention.
Figure 20:
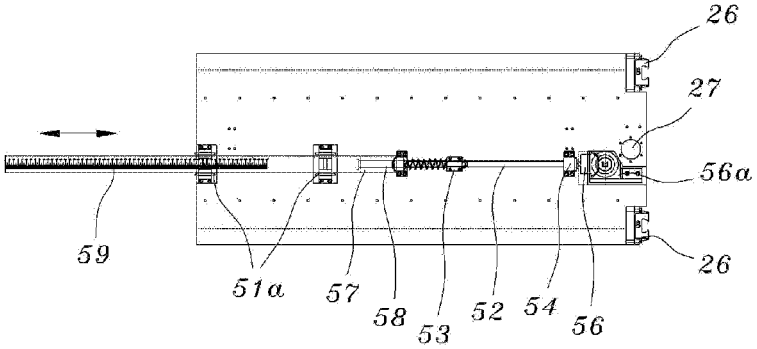
FIG. 20 represents a plan view of the horizontal moving bar constructed on the vertical moving table of FIG. 19.

That is, as illustrated in FIGS. 19 and 20, the horizontal moving bar 50 is built on the center part of the space between the upper plate 21 and the lower plate 22 of the vertical moving plate 20 and then the bracket 51*b* (see FIG. 9) comprising a guide roller 51*a* placed respectively on a position of both sides of the moving piece 51 of the horizontal moving bar 50 is fixed on the lower plate 22 by a locking member (non-illustrated).

Also, a hinge bracket 56 connected with the end of the moving piece 51 by the ball screw 52 is connected with the lower plate 22 of the vertical moving table 20 and support units 54 placed on the ends of the ball screw 52 of the horizontal moving bar 50 are fixed on the upper side of the lower plate 22 by a locking member (non-illustrated).

Figure 21:
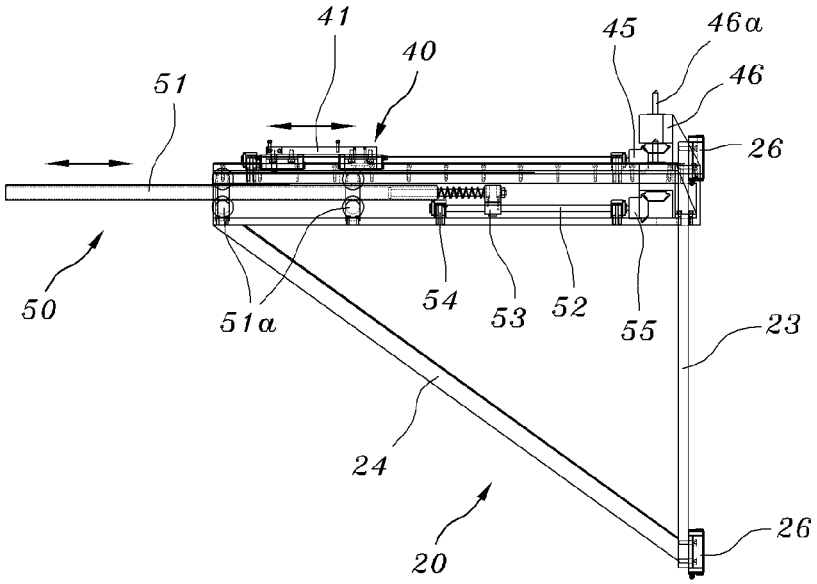
FIG. 21 represents a front view of the horizontal moving table of FIG. 7 and the horizontal moving bar constructed on the vertical moving table of FIG. 19 of the present invention.
Figure 22:
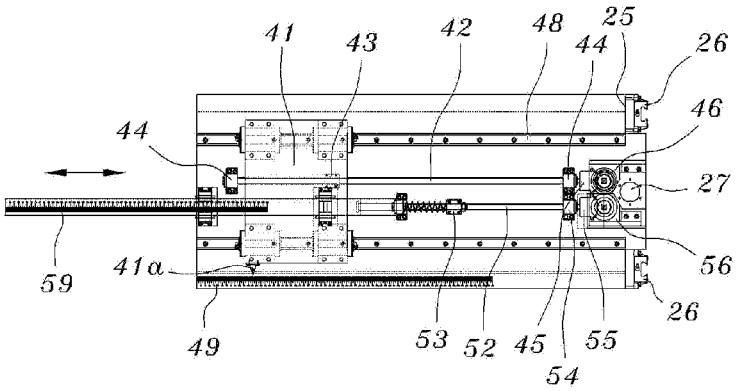
FIG. 22 represents a plan view of the horizontal moving table and the horizontal moving bar constructed on the vertical moving table of FIG. 21.

As stated above, placing the moving bar 50 between the upper plate 21 and the lower plate 22 of the vertical moving table 20 is illustrated in FIGS. 21 and 22.

In this manner, the horizontal moving table 40 is placed on the upper plate 21 of the vertical moving table 20 and the horizontal moving bar 50 is placed between the upper plate 21 and the lower plate 22 of the vertical moving table 20, thereby horizontally moving the horizontal moving table 40 and the horizontal moving bar 50 centering around the vertical moving table 20.

Meanwhile, the horizontal moving table 40 is placed on the upper plate 21 of the vertical moving table 20, the horizontal moving bar 50 is placed between the upper plate 21 and the lower plate 22 of the vertical moving table 20 and then the driving device 60 for driving the horizontal moving bar 50 is placed thereon, thereby finishing the combination procedure of the irradiation device 1 to test material using gamma rays radiated from a spent nuclear fuel assembly.

Figure 24:
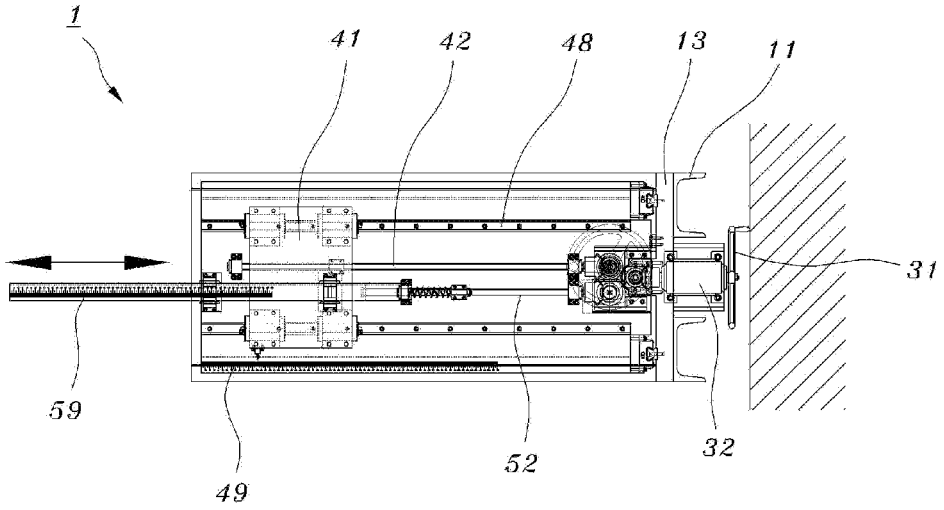
FIG. 24 represents a plan view of the irradiation device of FIG. 23.

In this place, as illustrated in FIGS. 23 and 24, the driving device 60 is combined with the guide hole 18*a* of the guide 18 placed on the upper side of the flat plate 13 of the support 10 by inserting therein and the coupling groove 63 having a square section is connected with the horizontal moving table 40.

That is, the driving bar 62 having a fixed length in a round bar shape of the driving device 60 is inserted and fixed in the guide hole 18*a* of the guide 18 placed on the upper side of the flat plate 13 of the support 10 and the lower side of the driving bar 62 in which the coupling groove 63 having a square section is formed is combined with the square section shaft 46*a* of the hinge bracket 46 placed on the end side of the horizontal moving table 40.

As stated above, the vertical moving table 20 is built on the support 10, the moving device 30 is built on the vertical moving table 20, the horizontal moving table 40 and the horizontal moving bar 50 are built on the vertical moving table 20 and the driving device 60 is built thereon, thereby finishing the combination procedure of an irradiation device 1 to test material using gamma rays radiated from a spent nuclear fuel assembly.

Meanwhile, in order to experiment on changes in all kinds of atomic power materials to radioactive rays radiated from a spent nuclear fuel assembly using the irradiation device 1 to test material using gamma rays radiated from a spent nuclear fuel assembly of the present invention, a shield and a storage reservoir for holding an experimental material are needed.

Figure 25:
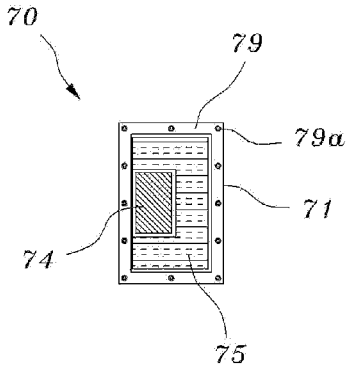
FIG. 25 represents a front view of a reservoir to hold a test material used in an irradiation device to test the material using gamma rays radiated from a spent nuclear fuel assembly of the present invention.
Figure 26:
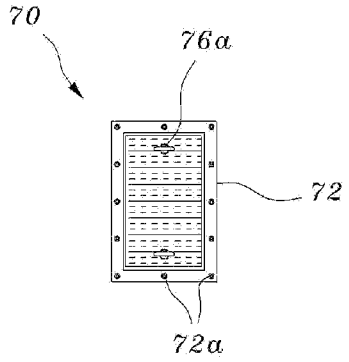
FIG. 26 represents a plan view of the reservoir of FIG. 25.
Figure 27:
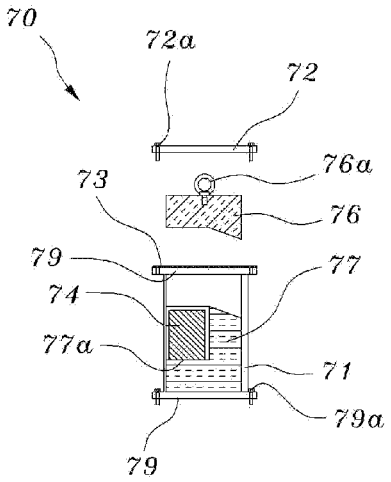
FIG. 27 represents an exploded view of the reservoir of FIG. 25.

In this manner, in the irradiation device 1 to test material using gamma rays radiated from a spent nuclear fuel assembly, the reservoir 70 for holding an experimental material is, as illustrated in FIGS. 25, 26 and 27, in the shape of a hexahedron with an open top which consists of a housing 71 having an atomic power material 74 and a shielding body 75 therein, a lid 72 placed on the open top of the housing 71 and a gasket 73 placed between the housing 71 and the lid 72 for sealing them up.

In this place, it is preferable that the gasket 73 be made of metal material and be in the shape of plate body for sealing up the housing 71 and the lid 72.

An example of the present invention teaches that the gasket 73 is placed between the lid 72 and the housing 71 for preventing a fluid from inflowing during working under water but an O-ring made of synthetic resin material containing rubber material or a rubber ring can be placed between the lid 72 and the housing 71.

In this place, a plurality of locking holes 72*a* having a locking member (non-illustrated) are pierced in the edge of the lid 72 and flanges 79 are placed respectively in the upper and lower edges of the housing 71 wherein a plurality of locking holes 79*a* for installing a locking member (non-illustrated) are pierced on a position of the flanges 79.

Meanwhile, the shielding body 75 built in the housing 71 consists of an upper shielding body 76 and a lower shielding body 77 and a setting groove 77*a* for inserting and installing an atomic power material 74 into one side of the lower shielding body 77 is formed.

In this place, an I bolt 76*a* for assembling and disassembling the shielding body is placed on a position of both upper sides of the upper shielding body.

As stated above, in the irradiation device 1 to test material using gamma rays radiated from a spent nuclear fuel assembly, the reservoir 70 for holding an experimental material is placed on the moving plate 41 of the horizontal moving table 40 of the irradiation device 1 to test material using gamma rays radiated from a spent nuclear fuel assembly.

Figure 28:
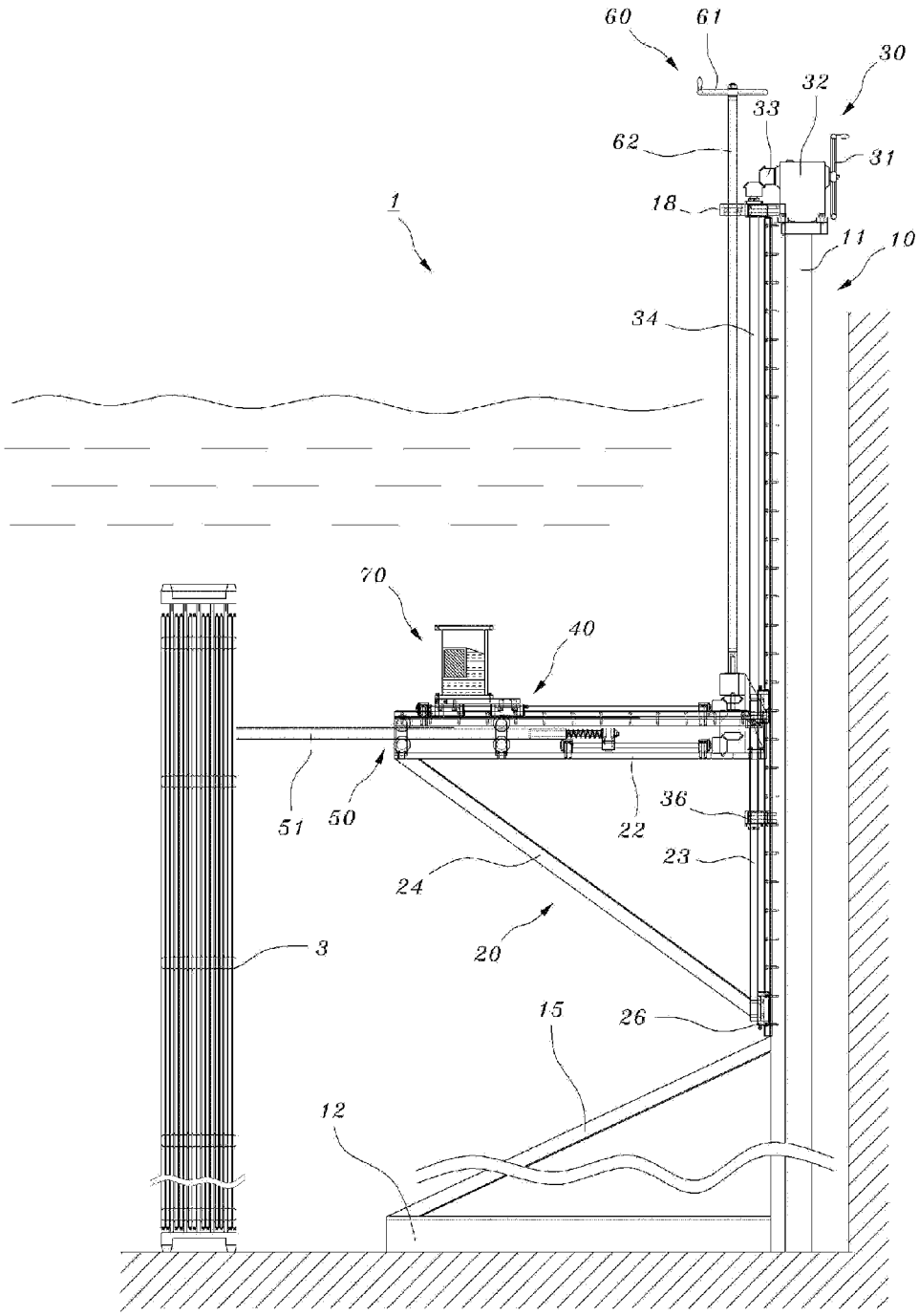
FIG. 28 represents a front view of an irradiation device to test material using gamma rays radiated from a spent nuclear fuel assembly of the present invention disposed adjacent to a spent nuclear fuel assembly stored in water.
Figure 29:
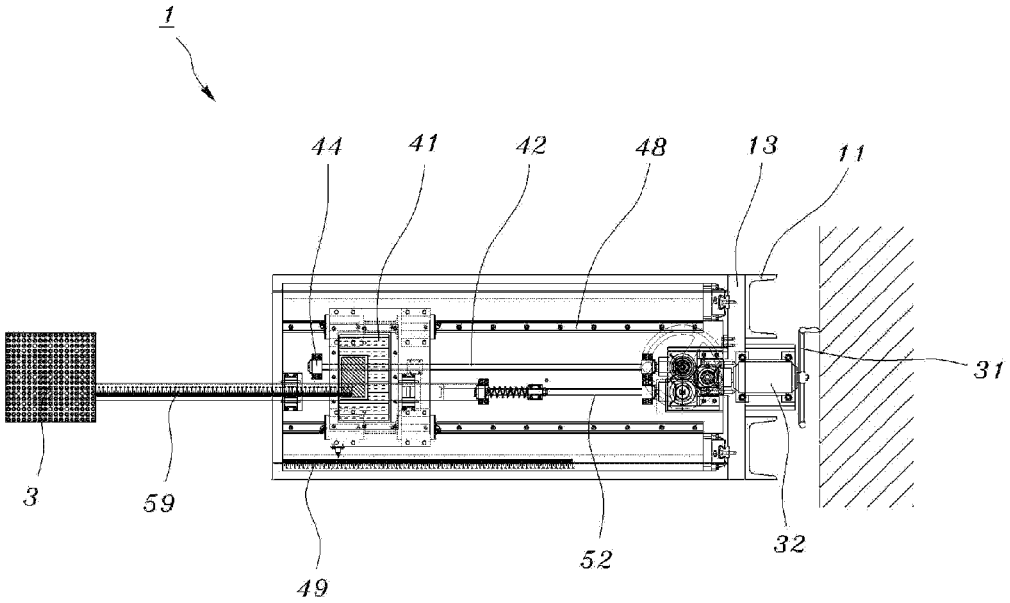
FIG. 29 represents a plan view of the irradiation device of FIG. 28 disposed adjacent to the spent nuclear fuel assembly stored in the water.

We explain a driving procedure of the irradiation device 1 to test material using gamma rays radiated from a spent nuclear fuel assembly of the present invention referring to FIGS. 28 and 29 hereinafter.

First of all, the irradiation device 1 to test material of the present invention is installed in a near position to a spent nuclear fuel assembly 3.

At this time, the reservoir 70 for holding nuclear fuel materials is installed on a horizontal moving table 40 of the irradiation device 1 for material test using a gamma ray radiated from a spent nuclear fuel assembly 3.

Also, by controlling the moving device 30 connected with the support 10 of the irradiation device 1 to test material using gamma rays radiated from the spent nuclear fuel assembly 3, the vertical moving table 20 installed on the support 10 to be movable upward and downward moves.

That is, by controlling the moving handle 31 of the moving device 30 connected with the support 10, the ball screw 34 connected with the decelerator 32 of the moving handle 31 and the bevel gear 33 spins and the ball screw nut 35 connected with the upper plate 21 of the vertical moving table 20 and placed on a position of the ball screw 34 by the spinning of the ball screw 34 moves upward and downward, thereby moving the vertical moving table 20 upward and downward.

At this time, the vertical moving table 20 is moved on the flat plate 13 of the support 10 upward and downward more easily by the slider blocks 26 placed on both sides of the vertical flat plate 23 of the vertical moving table 20 and the linear guide rails 14 combined with the slider blocks 26.

As stated above, by moving the vertical moving table 20 upward and downward centering around the support 10 with the moving device 30 to place on a position of the spent nuclear power fuel assembly 3 in a longitudinal direction and by controlling the driving device 60, the horizontal moving table 40 moves horizontally to the spent nuclear fuel assembly 3.

That is, the square section shaft 46*a* projected upward on the upper side of the hinge bracket 46 placed on the end of the horizontal moving table 40 is combined with the square section coupling groove 63 placed on the lower end of the driving bar 62 of the driving device 60 and then by controlling the driving handle 61 of the driving device 60, the ball screw 42 connected with the hinge bracket 46 by the bevel gear 45 spins and the ball screw nut 43 connected with the lower side of the moving plate 41 of the horizontal moving table 40 and placed on a position of the ball screw by the spinning of the ball screw 42 moves to move the horizontal moving table 40 horizontally centering around the vertical moving table 40.

At this time, slider blocks 47 placed respectively on both lower sides of the moving plate 41 of the horizontal moving table 40 move along linear guide rails 48 placed respectively on a position of both sides of the vertical moving table 20, thereby moving the moving plate 41 of the horizontal moving table 40 horizontally more easily.

In this place, it is possible to measure a moving distance of the horizontal moving table 40 by the pointer 41*a* placed on a position of the moving plate 41 of the horizontal moving table 40 and the scale 49 placed on a position corresponding to the pointer 41*a* and placed on the upper plate 21 of the vertical moving table 20.

Meanwhile, the driving device 60 is controlled, thereby moving the horizontal moving bar 50 horizontally to the spent nuclear power fuel assembly 3.

That is, the square section shaft 56*a* projected upward on the upper side of the hinge bracket 56 placed on the end side of the horizontal moving bar 50 is combined with the square section coupling groove 63 formed on the lower side of the driving bar 62 of the driving device 60 and then the ball screw 52 connected with the hinge bracket 56 by the bevel gear 55 by controlling the driving handle 61 of the driving device 60, the ball screw nut 53 moves horizontally by the spinning of the ball screw 52, the moving ball screw nut 53 is inserted into the damping spring 53*a* connected with the end side thereof and the slider bar 58 is combined with the slider block 57 connected with the damping spring 53*a*, thereby moving the moving piece 51.

At this time, it is possible to measure a distance between the spent nuclear fuel assembly 3 and the vertical moving table 20 by the scale 59 placed on the upper side of the moving piece 51 of the horizontal moving bar 50.

In this manner, by moving the vertical moving table 20 upward and downward to a position for irradiating gamma rays centering around the support 10 and moving the horizontal moving table 40 and the horizontal moving bar 50 horizontally, a moving distance of the horizontal moving table 40 and a distance between the vertical moving table 20 and the spent nuclear fuel assembly 3 are measured, it is possible to control the distance between the radiation materials and the spent nuclear fuel assembly 3 and make a research on the degeneration phenomenon of materials susceptible to the radiation and evaluate the radiation effects on the materials used at facilities and devices handling spent nuclear fuel under the real situation.

We explained the preferable example of the present invention above, but the scope of the present invention is not limited to such a specific example and it is possible for those skilled in the art to properly change the present invention within a scope described in the claims.

As stated above, the present invention having such a constitution teaches that an irradiation device 1 to test material to achieve a radiation effect evaluation is manufactured to be movable upward, downward and horizontally in order to study the hardening phenomenon of the materials susceptible to the radiation among the atomic power facilities using gamma rays radiated from a spent nuclear fuel assembly, thereby it is possible to adjust a position of the spent nuclear fuel used to test material using gamma rays radiated from the spent nuclear fuel and a test material, identify a distance between the spent nuclear fuel and the test material easily with a scale and evaluate the radiation effects on the materials used at facilities handling spent nuclear fuel under the same situation as they are really exposed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An irradiation device to test material using gamma rays radiated from a spent nuclear fuel assembly, the irradiation device comprising:

a support constructed vertically;

a vertical moving table movable upward and downward and connected with a position of the support;

a moving device to move the vertical moving table upward and downward;

a horizontal moving table movable horizontally and disposed on the vertical moving table;

a horizontal moving bar movable horizontally and disposed on the vertical moving table; and a driving device to drive the horizontal moving table and the horizontal moving bar horizontally, wherein the support comprises shaped steels, each having two wings and both wings spaced apart from each other by a fixed distance, a bottom plate disposed horizontally under the shaped steels, a flat plate having a plate body disposed in front of the shaped steels, and a linear guide rail disposed on each of a right side and a left side of a front surface of the flat plate, and wherein the vertical moving table comprises an upper plate comprising a plate body, a lower plate spaced apart from the upper plate by a fixed distance, the lower plate substantially the same length and shape as the upper plate, and a vertical flat plate disposed vertically on a one end of the upper plate and a corresponding one end of the lower plate.

2. The irradiation device of claim 1, wherein a guide having a flat plate body is disposed on a front-top of the flat plate, the guide is connected with the flat plate by a plate body and a guide hole is pierced on the top of the guide through the flat plate body.

3. The irradiation device of claim 1, wherein a support plate having a plate body is constructed on the top of the back side of the flat plate.

4. The irradiation device of claim 1, wherein both sides of the one ends of the upper plate and the lower plate have L-shaped coupling parts respectively and a plurality of slider blocks are disposed in the vertical direction to each of the coupling parts.

5. The irradiation device of claim 1, wherein a scale comprising a fixed length is disposed on a position of the upper plate.

6. The irradiation device of claim 1, wherein the moving device consists of a moving handle to apply a turning force, a decelerator to reduce the turning force provided by the moving handle, a bevel gear to apply a torque increased according as the turning force is reduced by the decelerator, a ball screw comprising a round bar shape connected with the bevel gear and a ball screw nut placed on a position of the ball screw.

7. The irradiation device of claim 1, wherein the horizontal moving table consists of a moving plate formed to be a plate body, a ball screw having a ball screw nut connected to a lower side of the moving plate, a bevel gear connected to one of the ends of the ball screw and a hinge bracket connected to the bevel gear.

8. The irradiation device of claim 7, wherein a plurality of slider blocks are placed on both sides of the lower side of the moving plate and a linear guide rail for moving the moving plate is combined with the slide blocks.

9. The irradiation device of claim 7, wherein a fixed part of a pointer in a position on the moving plate in the shape of a wedge is exposed to the outside.

10. The irradiation device of claim 1, wherein the horizontal moving bar consists of a moving piece in the shape of square bar, a ball screw having a ball screw nut connected with one end of the moving piece, a bevel gear connected with one end of the ball screw and a hinge bracket connected with the bevel gear.

11. The irradiation device of claim 10, wherein a slider block is formed on the end of the moving piece, a slide bar is connected with the slider block by inserting therein and an end of the slide bar and the ball screw nut are connected by a damping spring.

12. The irradiation device of claim 10, wherein brackets comprising a guide roller for guiding a movement of the moving piece are disposed respectively on both sides of the moving piece.

13. The irradiation device of claim 10, wherein a scale is disposed on the upper side of the moving piece.

14. The irradiation device of claim 1, wherein the driving device consists of a long driving bar comprising a round bar shape and a driving handle disposed on the top end of the driving bar.

15. The irradiation device of claim 1, wherein a shield and a reservoir for holding an atomic power material is further included.

16. The irradiation device of claim 15, wherein the reservoir consists of the shape of a hexahedron with an open top which comprises a housing comprising an atomic power material and shielding body therein and a lid disposed on the open top of the housing.

17. The irradiation device of claim 16, further comprising a gasket interposed between the housing and the lid.

18. The irradiation device of claim 16, wherein the shielding body comprises an upper shielding body, a lower shielding body and a setting groove to insert and install the atomic power material into one side of the lower shielding body.

* * * * *